US008509453B2

(12) United States Patent
Bychkov et al.

(10) Patent No.: US 8,509,453 B2
(45) Date of Patent: Aug. 13, 2013

(54) LUMINESCENT HEADPHONES WITHOUT BATTERY PACKS

(75) Inventors: Eyal Bychkov, Hod Hasharon (IL); Dov Moran, Kfar Saba (IL); Itay Sherman, Hod Hasharon (IL)

(73) Assignee: Google Inc., Mountain View, CA (US)

( * ) Notice: Subject to any disclaimer, the term of this patent is extended or adjusted under 35 U.S.C. 154(b) by 240 days.

(21) Appl. No.: 12/903,234

(22) Filed: Oct. 13, 2010

(65) Prior Publication Data

US 2011/0103607 A1 May 5, 2011

Related U.S. Application Data

(60) Provisional application No. 61/256,284, filed on Oct. 29, 2009.

(51) Int. Cl.
*H04R 1/10* (2006.01)

(52) U.S. Cl.
USPC ..... 381/74

(58) Field of Classification Search
USPC ..... 381/74
See application file for complete search history.

(56) References Cited

U.S. PATENT DOCUMENTS

| | | | | |
|---|---|---|---|---|
| 4,523,259 | A * | 6/1985 | Dorsett et al. | 362/120 |
| 4,869,566 | A * | 9/1989 | Juso et al. | 385/53 |
| 5,548,676 | A | 8/1996 | Savage, Jr. | |
| 7,319,762 | B2 | 1/2008 | Andrea et al. | |
| 2006/0250813 | A1 * | 11/2006 | Lippmann et al. | 362/551 |
| 2007/0123171 | A1 * | 5/2007 | Slamka et al. | 455/66.1 |
| 2007/0201227 | A1 * | 8/2007 | Camp et al. | 362/253 |

* cited by examiner

*Primary Examiner* — Ahmad Matar
*Assistant Examiner* — Katherine Faley
(74) *Attorney, Agent, or Firm* — Soquel Group LLC

(57) ABSTRACT

Audio apparatus, including an audio player, housed within a casing, for producing audio output, a port on a surface of the casing for inserting a headphone connector therein, a light emitting source, a power source, housed within the casing, for supplying power to the audio player and to the light emitting source, and a headphone for listening to audio output produced by the audio player, including a connector for insertion into the port, and a light pipe for transmitting light generated by the light emitting source.

5 Claims, 8 Drawing Sheets

LUMINESCENT HEADPHONES WITHOUT BATTERY PACKS

CROSS REFERENCES TO RELATED APPLICATIONS

This application claims benefit of U.S. Provisional Application No. 61/256,284, entitled LUMINESCENT HEADPHONES WITHOUT BATTERY PACKS, filed on Oct. 29, 2009 by inventors Eyal Bychkov, Dov Moran and Itay Sherman.

FIELD OF THE INVENTION

The field of the present invention is headphones for audio devices.

BACKGROUND OF THE INVENTION

Headphones (variously referred to as earphones and headsets) are being manufactured today with fashionable elements of different shapes, colors and sizes. Some headphones have luminescent elements that enable them to glow. One example of such a headphone set is the !Tude® illuminating earphone developed and manufactured by HelpDezk Ltd. of Hong Kong. Another example is the Mulit EL Flash Earphone developed and manufactured by WANYU Technology Development Co., Ltd of China.

U.S. Pat. No. 7,319,762 to Andrea et al. describes a headphone that incorporates light-emitting diodes (LEDs) in the ear-buds, and a control module that changes the LEDs' luminescent pattern according to audio being played. The ear-buds, referred to as Blinx by Andrea®, are developed and manufactured by Andrea Electronics Corporation of Bohemia, N.Y.

Many luminescent headphones and other accessories use electro-luminescent (EL) wires (variously referred to as Lytec™). EL-wire is a specially manufactured wire with a core of phosphorescent material coated flexible copper wire. When a high frequency voltage is applied, the EL wire glows like neon.

A drawback with EL-wires is their high power consumption. EL-wire accessories come with external battery packs. The !Tude® uses 2 AAA batteries (3V DC), and the Mulit EL Flash Earphone uses a rechargeable Lithium battery (5V DC~8V DC, 200 mA~500 mA). The !Tude and the Multi include transformers to convert the battery voltage to the high-voltage required for the EL-wires. The Blinx by Andrea® earphones use batteries in their control module.

Use of battery packs makes the prior art luminescent earphones uncomfortable and cumbersome. Moreover, use of transformers often causes a humming noise, which interferes with the audio experience.

Thus it would be of advantage to develop luminescent headphones that have low power consumption, and that do not require their own batteries.

SUMMARY OF THE DESCRIPTION

Aspects of the present invention relate to luminescent headphones for audio devices including inter alia cell phones, PDAs, radios, music players, pagers and answering machines. Embodiments of the present invention overcome drawbacks of the prior art by supplying power from the audio device to illuminate the headphones, thereby eliminating the need for accessory headphone batteries.

Further aspects of the present invention couple a headphone port and a light source having low power consumption, such as an LED. In a first embodiment of the present invention, the light source is a component of the audio device. In a second embodiment of the present invention, the light source is a component of the headphone but is nevertheless powered by the audio device.

The light source may receive its power from a VBUS signal carrying voltage to a USB connector. The light source may alternatively receive its power from a voltage line carrying voltage to an audio jack. The light source may yet alternatively receive its power from a high frequency inaudible audio signal coupled with an AC-to-DC converter.

The light source may be controlled to generate one of a variety of light patterns in the headphone, the patterns differing in frequencies, colors and intensities. The light pattern generated by the light source may correspond to operating characteristics of the audio device. Different light patterns may be generated in the headphone, corresponding to different profiles of configurable parameter settings, corresponding to incoming data (SMS) vs. incoming voice (phone call), corresponding to a volume setting, corresponding to a caller identifier, corresponding to a caller origin, and corresponding to many other such characteristics.

There is thus provided in accordance with an embodiment of the present invention audio apparatus, including an audio player, housed within a casing, for producing audio output, a port on a surface of the casing for inserting a headphone connector therein, a light emitting source, a power source, housed within the casing, for supplying power to the audio player and to the light emitting source, and a headphone for listening to audio output produced by the audio player, including a connector for insertion into the port, and a light pipe for transmitting light generated by the light emitting source.

There is additionally provided in accordance with an embodiment of the present invention a mobile communicator, including a wireless modem, housed within a casing, for receiving and transmitting data and voice signals, a port on a surface of the casing for inserting a headphone connector therein, a light emitting source, a power source, housed within the casing, for supplying power to the wireless modem and to the light emitting source, and a headphone for listening to voice signals received by the wireless modem, including a connector for insertion into the port, and a light pipe for transmitting light generated by the light emitting source.

BRIEF DESCRIPTION OF THE DRAWINGS

The present invention will be more fully understood and appreciated from the following detailed description, taken in conjunction with the drawings in which.

DETAILED DESCRIPTION

Aspects of the present invention relate to luminescent headphones that are powered by an audio device to which they connect. A light source with low power consumption is powered by the audio device, and emits light to luminescent wires within a headphone. When the headphone is connected to the audio device, the light source causes the headphone to glow. The term "audio device" as used herein refers to any electronic device that generates sound and to which a headphone may be connected, including inter alia an audio player or such other media player, a phone, a PDA or such other computer, and a pager.

Figure 1:
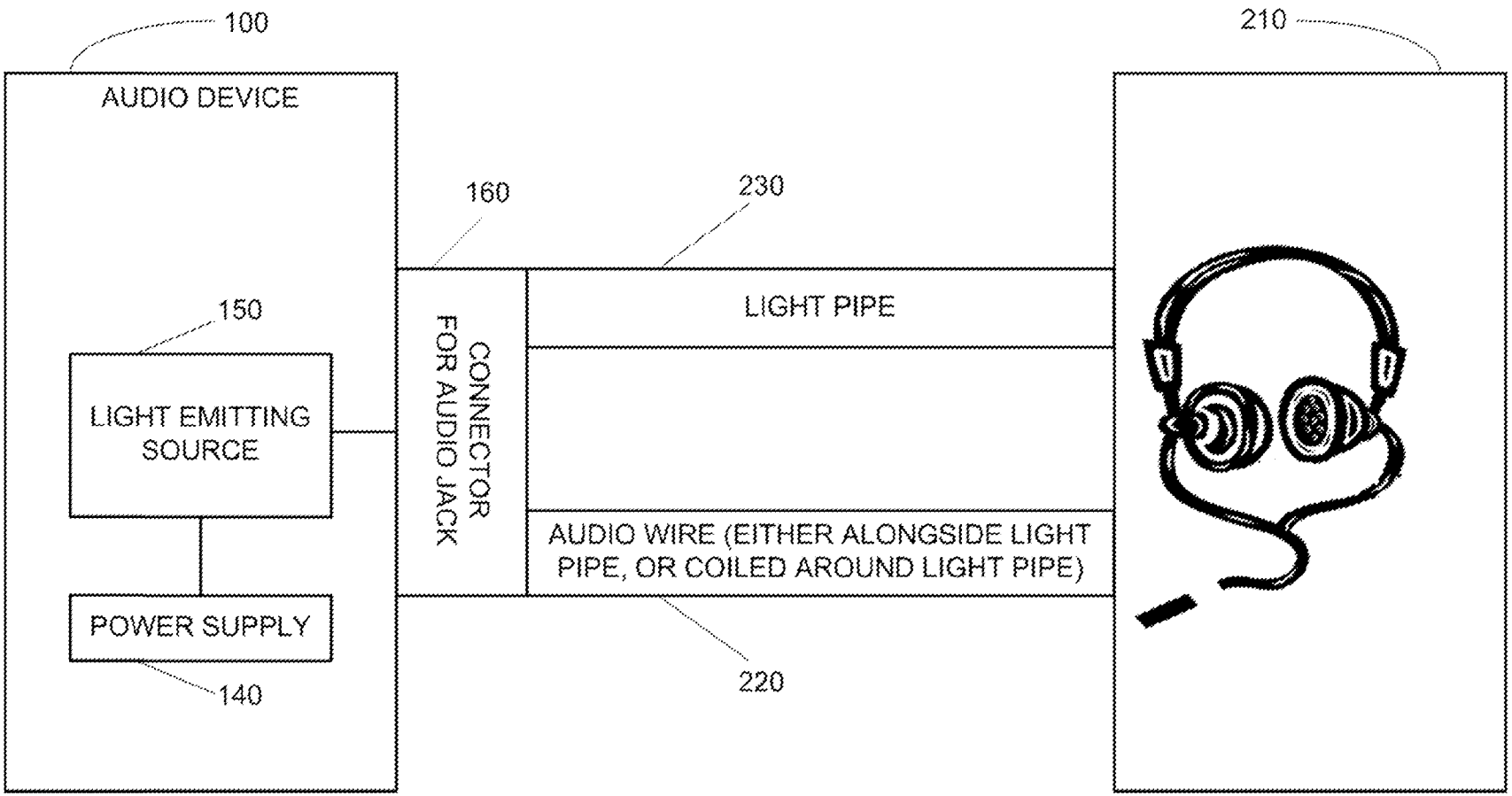
FIG. 1 is a simplified block diagram of a first configuration of luminescent headphones powered by an audio device to which the headphones are connected, in accordance with an embodiment of the present invention.
Figure 2:
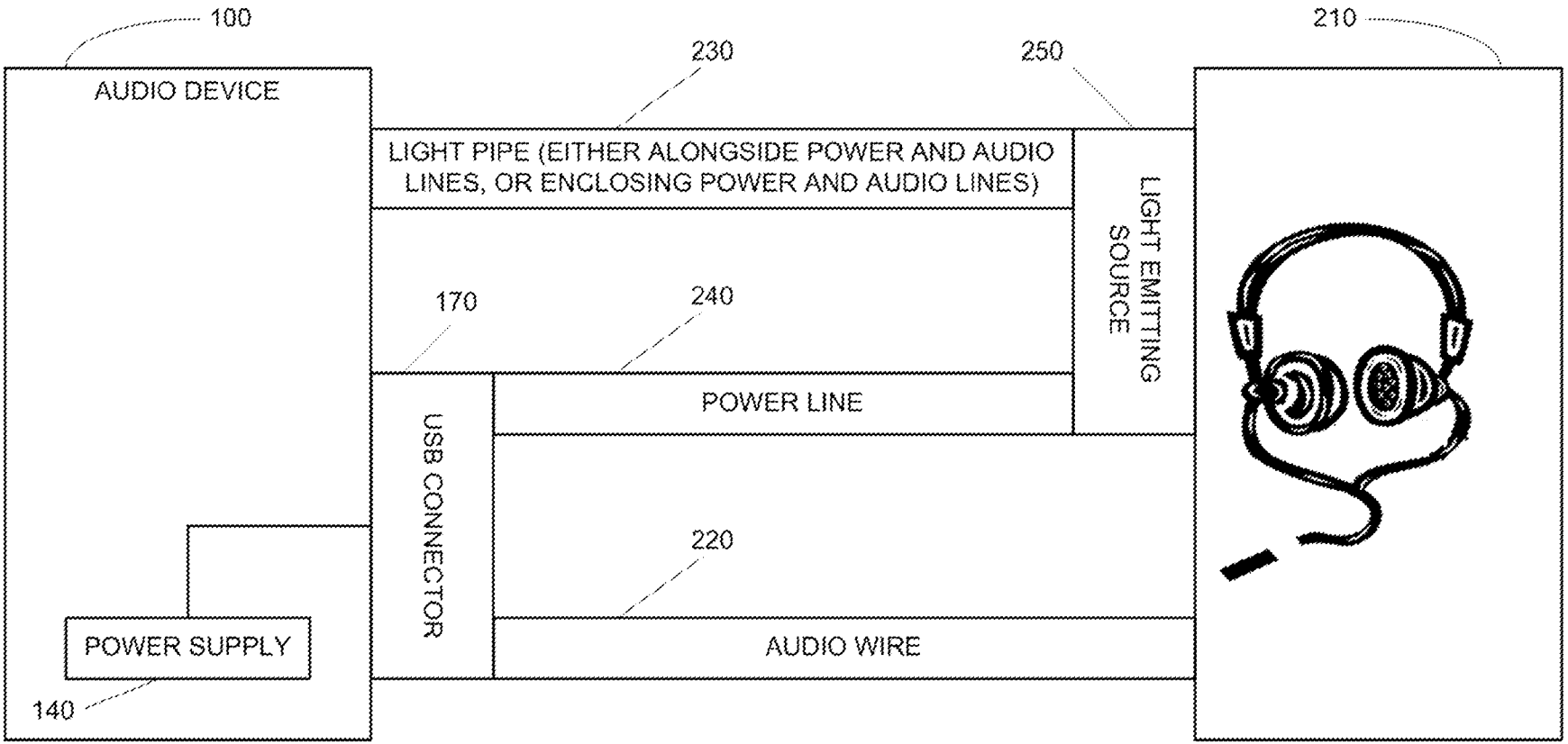
FIG. 2 is a simplified block diagram of a second configuration of luminescent headphones powered by an audio device to which the headphones are connected, in accordance with an embodiment of the present invention.
Figure 3:
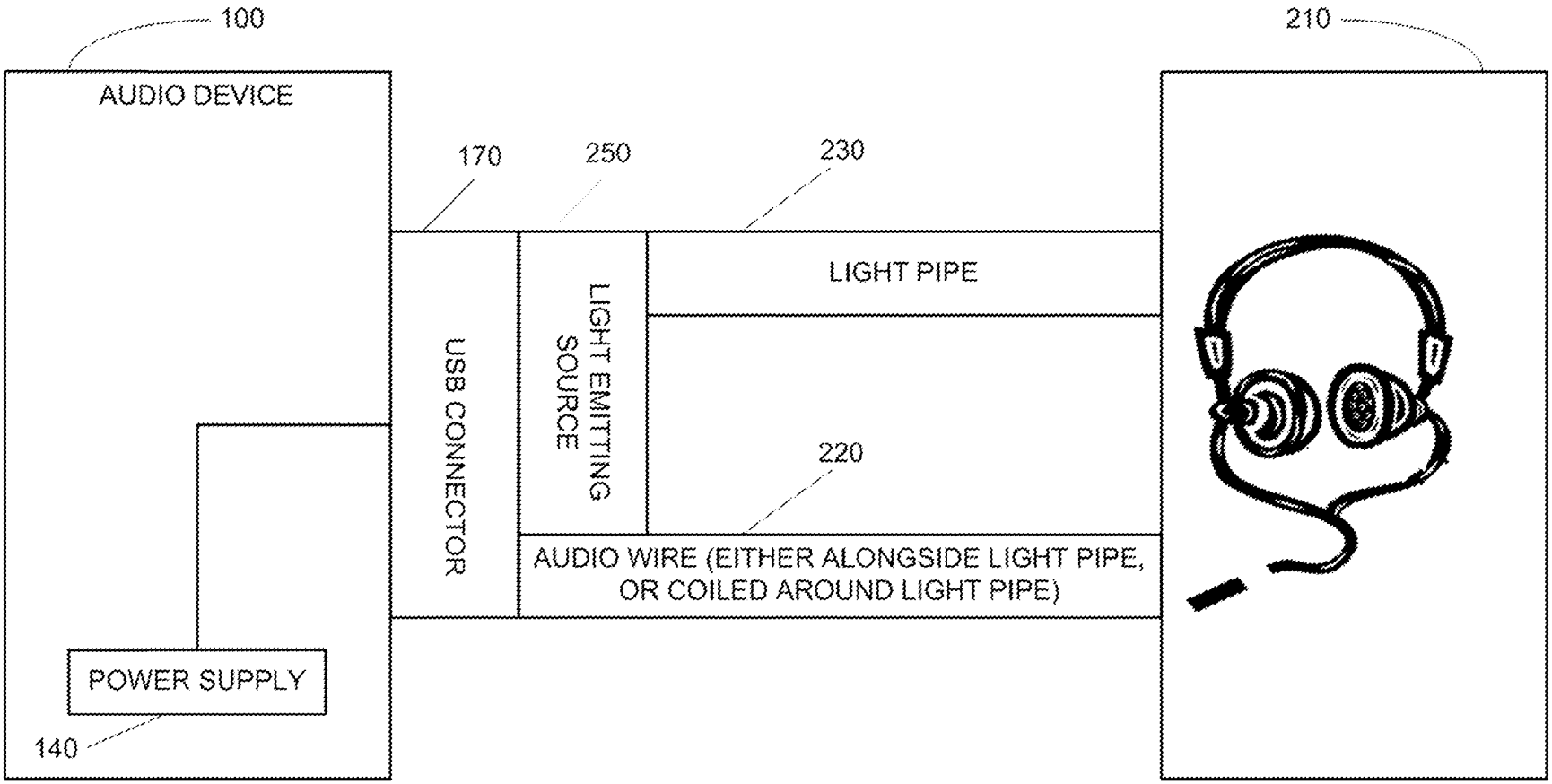
FIG. 3 is a simplified block diagram of a third configuration of luminescent headphones powered by an audio device to which the headphones are connected, in accordance with an embodiment of the present invention.

The present invention may be embodied in several hardware configurations, according to whether the light source is housed within the audio device or within the headphones, according to whether the headphones connect to the audio device via an audio jack or via a USB connector, and according to how the audio wires and luminescent wires are arranged. FIGS. 1-3 illustrate three of such configurations.

Reference is made to FIG. 1, which is a simplified block diagram of a first configuration of luminescent headphones powered by an audio device to which the headphones are connected, in accordance with an embodiment of the present invention. Shown in FIG. 1 is an audio device 100 including a power supply 140, a light emitting source 150 and a connector 160 for an audio jack. Light emitting source 150 may include one or more light-emitting diodes (LEDs), but other light sources are also contemplated by the present invention. Light emitting source 150 is powered by power supply 140.

Figure 4:
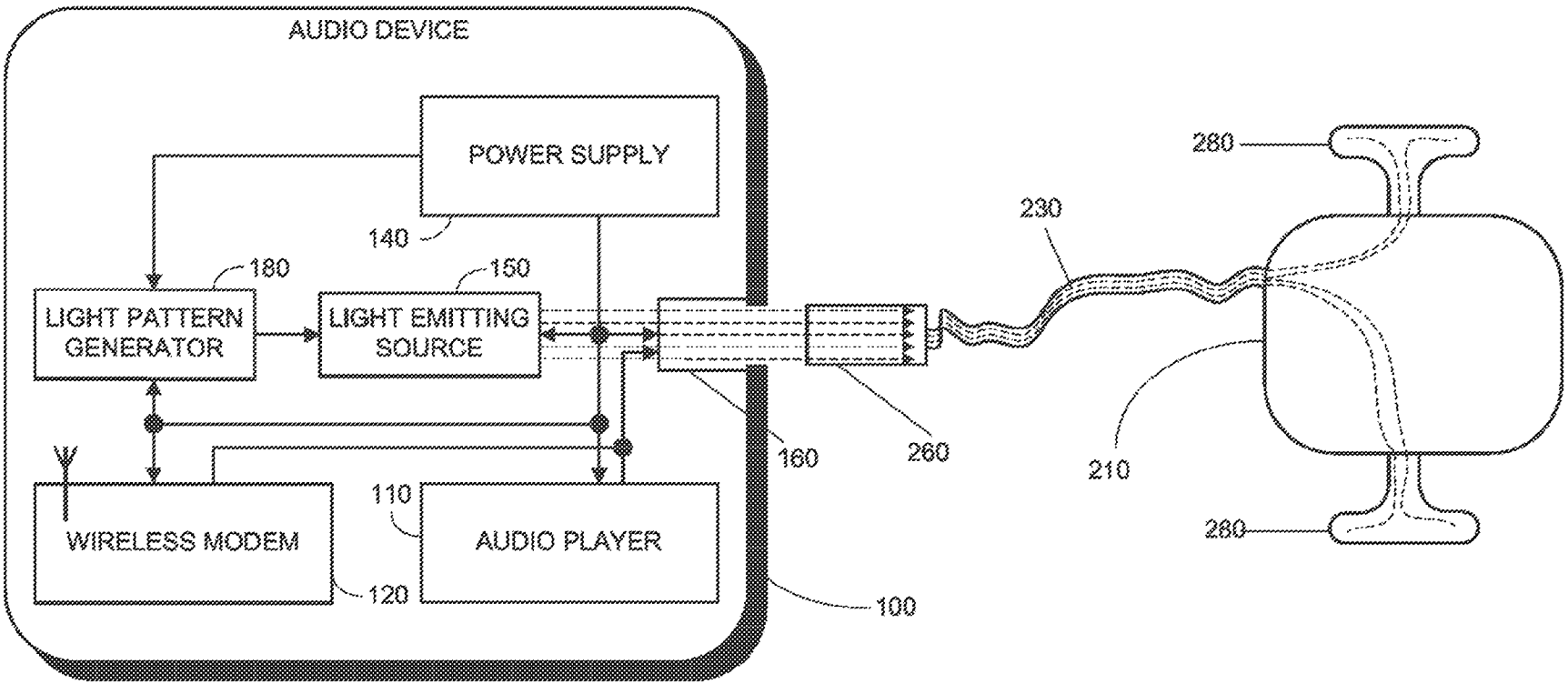
FIG. 4 is a simplified block diagram of an audio device with luminescent headphones, in accordance with the embodiment of the present invention shown in FIG. 1.
Figure 7:
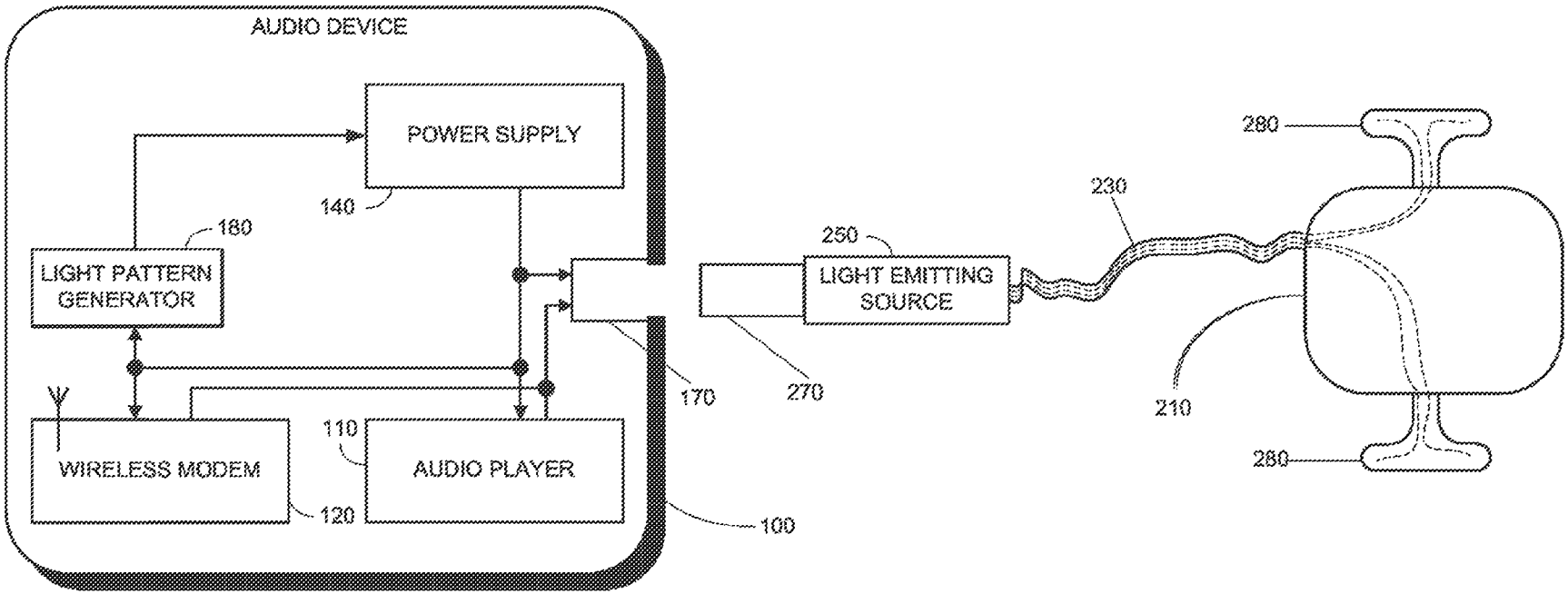
FIG. 7 is a simplified block diagram of an audio device with luminescent headphones, in accordance with the embodiment of the present invention shown in FIG. 2.

Audio device 100 includes other components, some of which are shown in FIGS. 4 and 7. However, these other components are generally common to many configurations, and it will be appreciated by those skilled in the art that FIGS. 1-3 are intentionally simplified in order to focus on essential differences between the configurations being illustrated.

Also shown in FIG. 1 is a headphone having a portion 210 with ear pieces that is positioned on a person's head, one or more audio wires 220 and, in accordance with an embodiment of the present invention, a light pipe 230. Light pipe 230 is a transparent tube or pipe for transporting light over its length. An example of light pipe 230 is the 3M™ Light Pipe manufactured by 3M Company of St. Paul, Minn. The 3M light pipe is lined with a film that is highly reflective to light striking the surface of the film at certain angles, and is transmissive at other angles. Light pipe 230 is illuminated by light emitting source 150 when the headphone is connected to audio device 100.

Audio wire(s) 220 may be positioned alongside light pipe 230 or coiled around light pipe 230. Alternatively audio wire (s) 220 may pass through light pipe 230. Two specific arrangements of audio wire(s) 220 and light pipe 230 are described hereinbelow with reference to FIG. 5.

Reference is made to FIG. 2, which is a simplified block diagram of a second configuration of luminescent headphones powered by an audio device to which the headphones are connected, in accordance with an embodiment of the present invention. In distinction from the configuration of FIG. 1, the light emitting source in FIG. 2 is a portion of the headphone. FIG. 2 shows audio device 100 having a USB connector 170. FIG. 2 also shows the headphone having one or more audio wires 220, a light pipe 230, a power line 240 and a light emitting source 250. Light emitting source 250 is powered by power supply 140, and power is transmitted to light emitting source 250 over power line 240. Light pipe 230 may be arranged alongside audio wire(s) 220 and power line 240, or may alternatively enclose audio wire(s) 220 and power line 240. Yet alternatively, light pipe 230 may enclose only audio wire(s) 220 or only power line 240.

Reference is made to FIG. 3, which is a simplified block diagram of a third configuration of luminescent headphones powered by an audio device to which the headphones are connected, in accordance with an embodiment of the present invention. As shown in FIG. 3, light emitting source 250 is connected to USB connector 170, through which it receives power from power supply 140. Audio wire(s) 220 may be arranged alongside light pipe 230, or alternatively may pass through light pipe 230.

Reference is made to FIG. 4, which is a simplified block diagram of audio device 100 with luminescent headphones, in accordance with the embodiment of the present invention shown in FIG. 1. Audio device 100 may be inter alia a media player, a PDA, a radio, a cellular telephone, a pager or an answering machine. A user may use a headphone to listen to the audio output of audio device 100.

Audio device 100 includes five primary components, housed within a casing; namely, an audio player 110, a wireless modem 120, a power supply 140, a light emitting source 150 and a light pattern generator 180. Power supply 140 supplies voltage to audio player 110, to wireless modem 120, to light emitting source 150 and to light pattern generator 180.

Audio device 100 also includes a port 160, in the surface of the casing, through which the headphone may be connected. In accordance with an embodiment of the present invention, both light and sound are transmitted through port 160. Light emitting source 150 generates the light that is transmitted through port 160, and audio player 110 and wireless modem 120 generate the sound that is transmitted through port 160. Light pattern generator 180 controls light emitting source 150 to generate any of a variety of light patterns. Light patterns generated by light pattern generator 180 may vary according to frequency, color, intensity, and other such properties of light.

The headphone includes two primary components; namely, a component with one or two ear pieces 280 that is positioned on a person's head, and a light pipe 230 for transmitting light.

The headphone includes a jack 260 that inserts into port 160, thereby connecting the headphone to audio device 100 and enabling a user to listen to audio output of audio device 100 through the one or two ear pieces 280. In one implementation of the present invention, jack 260 is a conventional audio jack, such as a 2.5 mm or 3.5 mm audio jack. In this implementation, one line out of audio device 100 is used for voltage and another line is used for ground.

When the headphone is connected to audio device 100, light emitted by light emitting source 150 is transmitted through light pipe 230, causing the headphone to glow. It will be appreciated by those skilled in the art that the requisite power for illuminating light pipe 230 is supplied by audio device 100.

There are several implementations of port 160 and the wire structure of the headphone that enable transmission of both light and sound from audio device 100 to the headphone. In this regard, reference is made to FIG. 5, which is a simplified diagram of two such implementations, in accordance with embodiments of the present invention. In the upper diagram, port 160 includes a center portion 161 and a peripheral portion 162. Sound is transmitted through center portion 161, and light is transmitted through peripheral portion 162. Peripheral portion 162 may be a simple opening in the casing of audio device 100. Alternatively, peripheral portion 162 may be a transparent surface. Yet alternatively, peripheral portion 162 may be an optical coupling connector. An example of such an optical coupling connector is the light pipe optical connector described in U.S. Pat. No. 5,548,676 to Savage, Jr.

Figure 5:
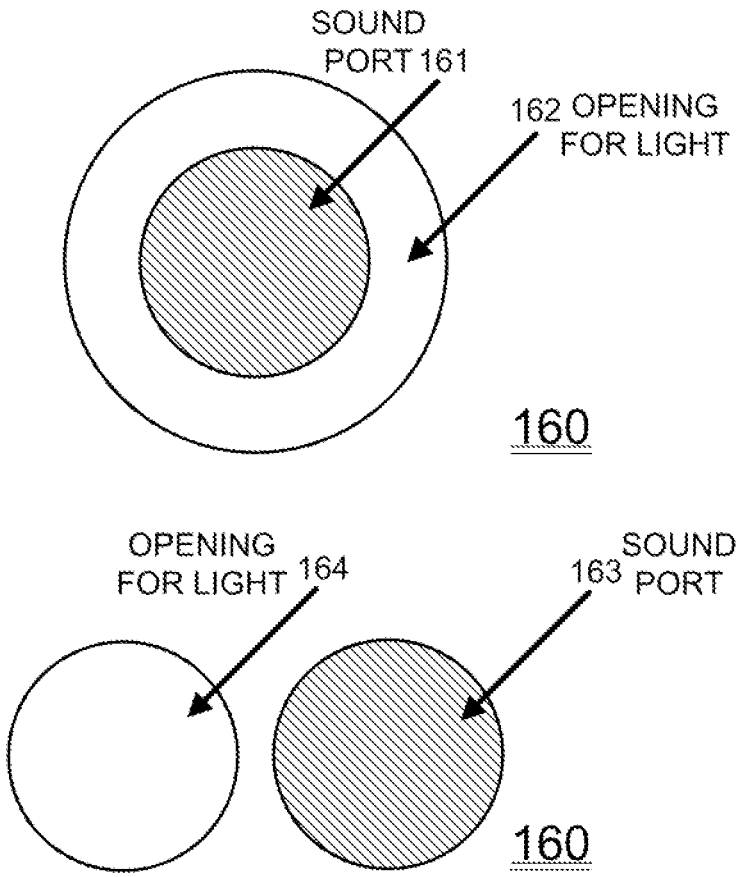
FIG. 5 is a simplified diagram of a port that transmits both light and sound to a headphone, in accordance with an embodiment of the present invention.
Figure 6:
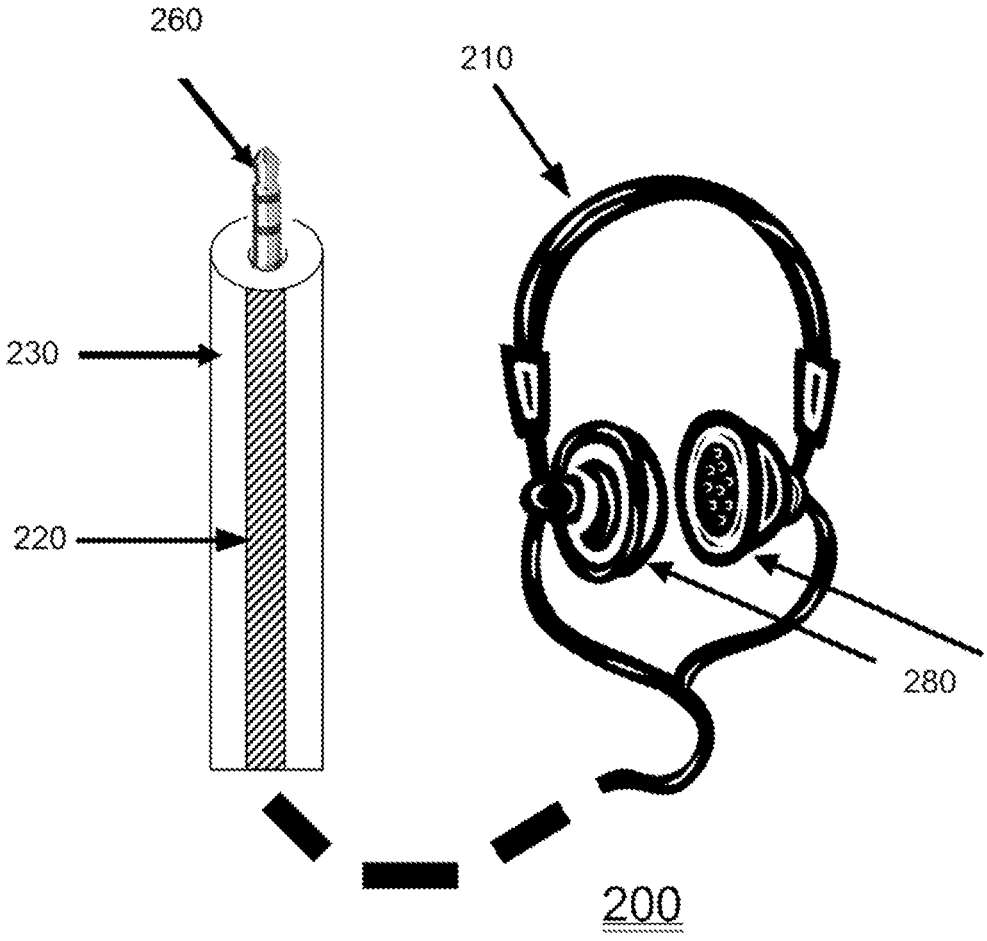
FIG. 6 is a simplified diagram of a headphone having a jack that comprises an audio cable in its center, and a light pipe in its periphery, in accordance with an embodiment of the present invention.

Corresponding to FIG. 5, reference is made to FIG. 6, which is a simplified diagram of a headphone 200 having a jack 260 that comprises an audio cable 220 in its center, and light pipe 230 in its periphery, in accordance with an embodiment of the present invention. Light emitted through peripheral portion 162 of port 160 is transmitted through the peripheral light pipe 230 of headphone 200. Sound emitted through center portion 161 of port 160 is transmitted through the center audio cable 220 of headphone 200.

In the lower diagram of FIG. 5, port 160 comprises two adjacent portions; namely, a portion 163 for transmitting sound, and a portion 164 for transmitting light. As above, portion 164 may be inter alia a simple opening in the casing of audio device 100, or a transparent surface, or an optical coupling connector.

In various implementations of the present invention, audio device 100 may contain one or both of audio player 110 and wireless modem 120. For example, audio device 100 may be a cell phone with a wireless modem 120, but lacking an audio player 110. Alternatively, audio device 100 may be a music player or a radio with an audio player 110, but lacking a wireless modem 120.

Similarly, in various implementations of the present invention, audio device 100 may contain other components, not illustrated in FIG. 4 for the sake of clarity of presentation, such as one or more microprocessors, a microphone, one or more speakers, a display screen, and one or more user interface controls including inter alia a keypad, buttons, switches, sliders and dials.

Reference is made to FIG. 7, which is a simplified block diagram of an audio device with luminescent headphones, in accordance with the embodiment of the present invention shown in FIG. 2. In distinction from the embodiment shown in FIG. 4, where light emitting source 150 is a component of audio device 100, in the embodiment of FIG. 7, a light emitting source 250 is a component of the headphone. Nevertheless, light emitting source 250 is still powered by power supply 140 and is still controlled by light pattern generator 180. Light pattern generator 180 typically controls the power supplied by power supply 140.

When the headphone is connected to audio device 100, light emitted by light emitting source 250 is transmitted through light pipe 230, causing the headphone to glow. It will be appreciated by those skilled in the art that the requisite power for illuminating light pipe 230 is supplied by audio device 100.

In one implementation of the present invention, connector 170 is a mufti-pin USB connector, such as a mini-USB or micro-USB connector. In this implementation, light emitting source 250 draws power from a pin for a VBUS signal line of audio device 100.

Figure 8:
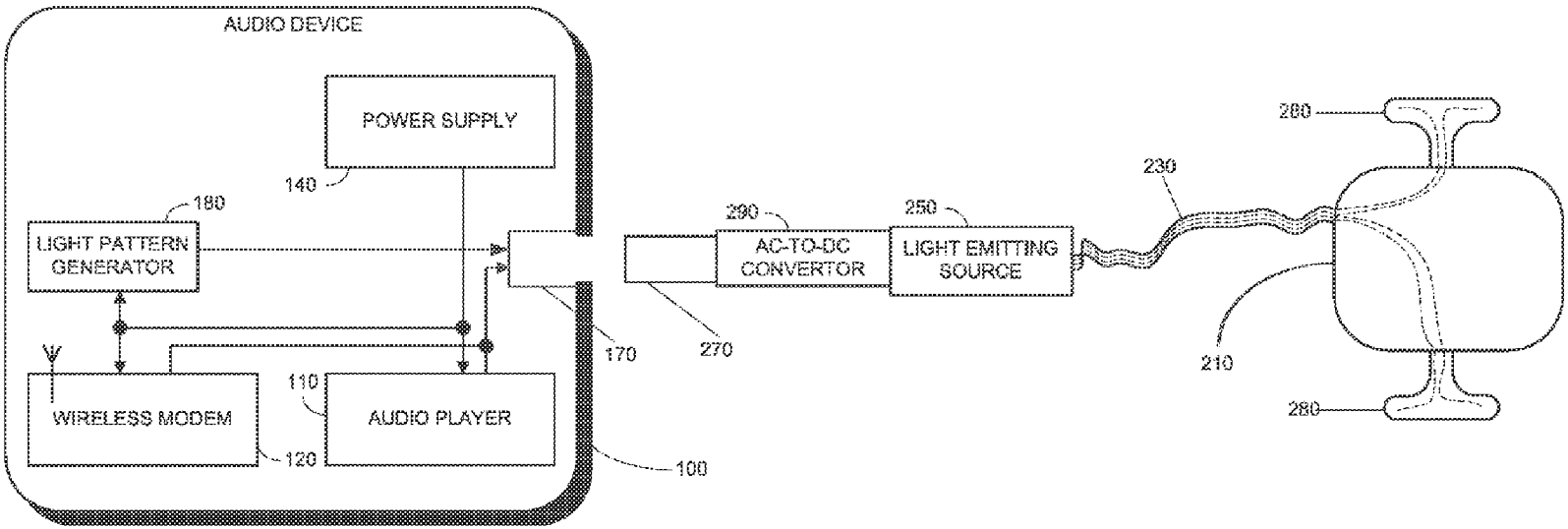
FIG. 8 is a simplified block diagram of an audio device with luminescent headphones, in accordance with another embodiment of the present invention.

In another implementation of the present invention, shown in FIG. 8, an audio tone produced by audio device 100 is used to supply power to light emitting source 250. In this implementation, an inaudible frequency above 20 KHz is produced and coupled to an AC-to-DC converter 290, which in turn is connected to light emitting source 250.

In accordance with embodiments of the present invention, the light patterns generated by light pattern generator 180 may be controlled so as to correspond with certain operating characteristics of audio device 100. Such correspondence includes inter alia:

- light pattern corresponding to volume of audio output produced by audio device 100;
- light pattern corresponding to connectivity status of audio device 100 (standby/during a phone call);
- light pattern corresponding to incoming data or voice signal (SMS/incoming phone call); e.g., the light may blink once if an SMS is received, and continue to blink until an incoming call is answered;
- light pattern corresponding to caller group, as defined by a user (family/friends/unknown);
- light pattern corresponding to caller's phone number (country of origin/wireless operator); and
- light pattern corresponding to a current profile setting of audio device 100 (normal/meeting/silent), the profile being a user configurable selection of parameter settings.

In the foregoing specification, the invention has been described with reference to specific exemplary embodiments thereof. It will, however, be evident that various modifications and changes may be made to the specific exemplary embodiments without departing from the broader spirit and scope of the invention as set forth in the appended claims. Accordingly, the specification and drawings are to be regarded in an illustrative rather than a restrictive sense.

What is claimed is:

1. Audio apparatus, comprising: an audio player, housed within a casing, for producing audio output; a port on a surface of the casing for inserting a headphone connector therein, through which sound produced by said audio player is transmitted; a power source, housed within the casing, for supplying power to said audio player; and a headphone for listening to audio output produced by said audio player, comprising: a connector for insertion into said port; an AC-to-DC convertor; an LED light emitting source for generating light, the light emitting source being powered via said AC-to-DC converter by an audio tone produced by said audio player at an inaudible high frequency above 20 KHz; and a light pipe for transmitting light generated by said light emitting source.

2. The audio apparatus of claim 1 wherein said connector is a USB connector.

3. The audio apparatus of claim 1 wherein said connector is an audio jack.

4. The audio apparatus of claim 1 further comprising a light pattern generator, housed within the casing and receiving power from said power source, for controlling said light emitting source to generate any one of a plurality of light patterns.

5. The audio apparatus of claim 4 wherein said light pattern generator generates a light pattern according to volume of audio output produced by said audio player.

* * * * *